US008845400B2

(12) United States Patent
Imai et al.

(10) Patent No.: US 8,845,400 B2
(45) Date of Patent: Sep. 30, 2014

(54) ROTARY GRINDING TOOL AND ITS PRODUCTION METHOD

(75) Inventors: Atsumi Imai, Chiba (JP); Takehide Aiga, Chiba (JP); Masanori Nagai, Tochigi (JP); Takayuki Sato, Tochigi (JP); Kenji Fujimoto, Tokyo (JP); Tsuyoshi Matsumoto, Tochigi (JP); Hiroshi Kihira, Chiba (JP)

(73) Assignees: Nippon Steel & Sumikin Anti-Corrosion Co., Ltd., Tokyo (JP); Dai Nippon Toryo Co., Ltd, Osaka (JP)

( * ) Notice: Subject to any disclaimer, the term of this patent is extended or adjusted under 35 U.S.C. 154(b) by 246 days.

(21) Appl. No.: 13/504,381

(22) PCT Filed: Dec. 21, 2010

(86) PCT No.: PCT/JP2010/072945
§ 371 (c)(1),
(2), (4) Date: Jun. 22, 2012

(87) PCT Pub. No.: WO2011/078139
PCT Pub. Date: Jun. 30, 2011

(65) Prior Publication Data

US 2012/0270484 A1 Oct. 25, 2012

(30) Foreign Application Priority Data

Dec. 22, 2009 (JP) ..... 2009-290224

(51) Int. Cl.
*B24D 7/02* (2006.01)
*B24D 3/06* (2006.01)

(52) U.S. Cl.
CPC ... *B24D 3/06* (2013.01); *B24D 7/02* (2013.01)
USPC ..... 451/548; 451/549; 451/550; 451/551

(58) Field of Classification Search
CPC ..... B24D 7/066; B24D 7/16; B24D 7/02; B24D 7/04
USPC ..... 451/548, 549–551
See application file for complete search history.

(56) References Cited

U.S. PATENT DOCUMENTS 4,694,615 A * 9/1987 MacKay, Jr. ..... 451/342
4,907,376 A * 3/1990 Bouchard et al. ..... 451/548

(Continued)

FOREIGN PATENT DOCUMENTS

JP 57066864 A * 4/1982 ..... B24D 3/06
JP A-2003-159656 6/2003

(Continued)

OTHER PUBLICATIONS

Jan. 25, 2011 Written Opinion of the International Searching Authority issued in International Patent Application No. PCT/JP2010/072945 (with partial translation).

(Continued)

*Primary Examiner* — George Nguyen
(74) *Attorney, Agent, or Firm* — Oliff PLC

(57) ABSTRACT

An inexpensive rotary grinding tool with reduced noise level of the grinding is provided. The rotary grinding tool comprises a metal disk having a grinding surface on at least a part of its surface and a holder for supporting the metal disk. The grinding surface has hard grains having a Mohs hardness in excess of 9 brazed thereon at a surface density of at least 20 grains/cm$^2$. The holder has at its center a securing means for securing the holder on rotary shaft of a rotary drive unit. The holder and the metal disk are joined together to constitute the rotary grinding tool.

10 Claims, 4 Drawing Sheets

(56) References Cited

U.S. PATENT DOCUMENTS

| | | | | |
|---|---|---|---|---|
| 4,910,924 | A * | 3/1990 | Bouchard et al. | 451/548 |
| 5,092,082 | A * | 3/1992 | Padberg et al. | 451/548 |
| 5,222,333 | A * | 6/1993 | Watanabe et al. | 451/533 |
| 5,261,385 | A * | 11/1993 | Kroll | 125/13.01 |
| 5,468,178 | A * | 11/1995 | Kitko et al. | 451/548 |
| 5,567,503 | A * | 10/1996 | Sexton et al. | 428/143 |
| 5,645,618 | A * | 7/1997 | Monroe et al. | 51/309 |
| 5,752,876 | A * | 5/1998 | Hettes | 451/463 |
| 5,997,597 | A * | 12/1999 | Hagan | 51/309 |
| 6,220,949 | B1 * | 4/2001 | Hayashi et al. | 451/548 |
| 6,280,309 | B1 * | 8/2001 | Van Osenbruggen | 451/415 |
| 6,712,683 | B2 * | 3/2004 | Brandstetter | 451/550 |
| 6,761,746 | B2 * | 7/2004 | Rich et al. | 51/297 |
| 8,366,521 | B2 * | 2/2013 | Kim | 451/548 |
| 2001/0025457 | A1 * | 10/2001 | Tselesin | 51/293 |
| 2005/0108948 | A1 * | 5/2005 | Sung | 51/307 |
| 2006/0211353 | A1 * | 9/2006 | Kodani et al. | 451/548 |
| 2006/0225720 | A1 * | 10/2006 | Andrews et al. | 125/11.04 |
| 2007/0037501 | A1 * | 2/2007 | Buljan et al. | 451/548 |
| 2008/0287049 | A1 * | 11/2008 | Salzgeber et al. | 451/548 |
| 2009/0274524 | A1 * | 11/2009 | Hidai et al. | 407/34 |
| 2011/0212674 | A1 * | 9/2011 | Ficai | 451/548 |
| 2012/0178345 | A1 * | 7/2012 | Wiand et al. | 451/42 |
| 2012/0231712 | A1 * | 9/2012 | Wu et al. | 451/548 |
| 2012/0244791 | A1 * | 9/2012 | Andrews et al. | 451/443 |
| 2013/0331015 | A1 * | 12/2013 | Kimoto et al. | 451/548 |
| 2013/0331016 | A1 * | 12/2013 | Kimoto et al. | 451/548 |

FOREIGN PATENT DOCUMENTS

| | | |
|---|---|---|
| JP | A-2004-174703 | 6/2004 |
| JP | A-2004-276197 | 10/2004 |
| JP | A-2007-307701 | 11/2007 |
| JP | A-2009-006478 | 1/2009 |

OTHER PUBLICATIONS

International Search Report issued in International Application No. PCT/JP2010/072945 dated Jan. 25, 2011 (with translation).

* cited by examiner

ROTARY GRINDING TOOL AND ITS PRODUCTION METHOD

TECHNICAL FIELD

This invention relates to a rotary grinding tool and its production method.

BACKGROUND ART

Rust forms on steel structures such as bridge, plant, ship, and building with lapse of time. Accordingly, corrosion resistant alloy steels such as weathering steel with retarded corrosion speed are recently used for the members of steel structures such as bridge. However, thick, high density, and adhesive layered rust and imbricate rust are formed under some environmental conditions to which they are exposed. The rust invites deterioration of the steel structure, and therefore, the life of the steel structure should be elongated by coating the steel structure after removing the rust. Early removal of the rust and subsequent coating of the steel matrix are required especially when the rust is thick since the steel structure has the risk of suffering from safety problems during its use.

In the steel making, a large amount of steel casting is sometimes stored in the exterior for prolonged time according to the production plan. Since steel making are normally located in the seaside area, thick rust is likely to be formed on the steel casting by the airborne salt grains wafting from the ocean. In such a case, the thick rust should be removed before subjecting the steel to the hot rolling step since the rust results in the surface defects and scabs which result in the loss of commercial value.

However, complete removal of the rust formed on the steel structure or the steel casting is technically an extremely difficult task, and a large noise is usually generated in the removal of such thick rust and heavy burden is placed on the operator.

For example, alumina- or silicone carbide-based grinders and paper grinders have been used for the removal of the rust formed on the steel material. However, when the rust is thick, high density, and adhesive, grinding of such rust having a hardness higher than the alumina or the silicon carbide is difficult by using such material for the grinding.

The thick and firm rust may also be removed by a power tool such as jet chisel. However, this method which is capable of conducting rough grinding is incapable of conducting the precise grinding. More specifically, removal of the rust and exposure of the steel matrix to a degree sufficient for the subsequent coating is difficult when thin rust has firmly deposited on the steel surface. Also, the loud noise in this process is a great burden for the operator.

Also, the rust may be removed by blasting. Blasting, however, has the problem of terrible noise and it also requires large scale apparatus and high cost.

In view of such situation, the inventors of the present invention proposed, in Patent Document 1, a rotary grinding tool capable of removing thick and firmly bonded rust on a steel structure with a large surface area such as bridge in an effective, efficient, and convenient manner at high speed and low cost, with high safety and workability. This rotary grinding tool has high rust removing and surface exposing ability and this tool can conduct the rust removal and the steel surface exposure at once. In this rotary grinding tool, hard grains having a particular hardness are provided on the grinding surface of the metal rotary disk at a particular surface density so that the grains are exposed to a certain extent. Patent Document 1 discloses a curved rotary grinding tool having a grinder disk surface including the part where the angle between the normal line of the grinder disk surface and the rotary axis is in the range of at least 1° to up to 45°, and the grinder peripheral surface includes the part where the cross-section parallel to the rotational center has a radius of curvature R of at least 1 mm and up to 10 mm. The only embodiments disclosed in Patent Document 1 are those having such curved grinding surface.

Similar rotary grinding tool is disclosed in Patent Document 2. The Patent Document 2 proposes a diamond grinder disk having a plurality of diamond grain pieces secured to the surface of the disk having the grinding function. In this diamond grinder disk, the distance between two adjacent diamond grain pieces on a particular rotation track is larger than the distance between the diamond grain piece on the particular rotation track and the nearest diamond grain piece on the rotation track radially adjacent to the particular track. Patent Document 2 describes that such diamond grinder disk can be used with no substantial difference from conventional commercial products; all diamond grain pieces contributes efficiently and equally to the grinding process; the diamond grain pieces are unlikely to experience uneven abrasion even after prolonged use; and grinded rust is smoothly discharged from the center to the periphery of the disk surface.

CITATION LIST

Patent Literature

[Patent Literature] JP 2007-307701 A
[Patent Literature] JP 2009-6478 A

SUMMARY OF INVENTION

Technical Problem

However, improvement in the tools described in Patent Documents 1 and 2 was insufficient since these tools suffered from large noise during the grinding which was a burden for the operator. The tools described in Patent Documents 1 and 2 also had the drawback of relatively high cost.

Efficient removal of layered rust using the grinding tool having a curved grinding surface described in Patent Document 1 was difficult since the curved surface only partly (approximately one third) became in contact with the rust even when the grinding surface was pushed against the rust surface.

Grinding of the rust at the corner of a structure using the rotary grinding tool having a flat or curved surface of Patent Document 1 or 2 was also difficult. For example, removal of the rust at the boundary between the floor and the wall using the rotary grinding tool of Patent Document 1 or 2 was very difficult. In the case of the curved grinding surface described in Patent Document 1, it was not easy to push the peripheral grinding surface against the boundary between the floor and the wall, and in the case of the flat grinding surface of Patent Document 2, the area of the grinding surface pushed against the boundary part was quite limited even if the grinding surface could be pushed against the boundary, and the grinding could not be efficiently accomplished.

As described above, no rotary grinding tool has so far been developed which has excellent low noise level with reduced noise in the grinding, which is relatively inexpensive, and which is capable of grinding both the layered rust and the rust at the corner of structures at a higher efficiency An object of the present invention is to provide an inexpensive rotary grinding tool with excellent noise property with reduced noise in the grinding.

Another object of the present invention is to provide a rotary grinding tool which is capable of grinding both the layered rust and the rust at the corner of structures at a higher efficiency.

A further object of the present invention is to provide a method for producing such rotary grinding tool.

Solution to Problem

The inventors of the present invention conducted an intensive study to solve the problems as described above, and completed the present invention.

The present invention is as described below in (1) to (11).

(1) A rotary grinding tool with reduced noise level comprising a metal disk having a grinding surface on at least a part of its surface, the grinding surface having hard grains having a Mohs hardness in excess of 9 brazed thereon at a surface density of at least 20 grains/cm$^2$, and a holder for supporting the metal disk, the holder having at its center a securing means for securing the holder on rotary shaft of a rotary drive unit, the metal disk being joined to the holder.

(2) A rotary grinding tool with reduced noise level according to the above (1) wherein the surface of the metal disk has a front surface, a sloped surface, a side surface, and a rear surface, the front surface, the sloped surface, and the side surface being continuously formed in this order from the center side to the peripheral side of the metal disk, the rear surface being located at the back of the front surface and the sloped surface and adjacent to the side surface, and the front surface being a surface perpendicular to the rotary axis and the side surface being a surface parallel to the rotary axis.

(3) A rotary grinding tool with reduced noise level according to the above (1) or (2) wherein a space is formed on the front side of the securing means by the joining of the metal disk with the holder, and the space has a volume of at least 7000 mm$^3$.

(4) A rotary grinding tool with reduced noise level according to any one of the above (1) to (3) wherein a space is formed on the front side of the securing means between the metal disk and the holder, and the space is at least 7000 mm$^3$.

(5) A rotary grinding tool with reduced noise level according to any one of the above (1) to (4) wherein the metal disk has a thickness of 3.0 to 6.0 mm and a weight of 100 to 1000 g, the holder has a thickness of 3 to 10 mm, and percentage of the contact area of the metal disk and the holder in the area of the rear surface of the metal disk is 30 to 100%.

(6) A rotary grinding tool with reduced noise level according to any one of the above (1) to (5) wherein the metal disk comprises a stainless steel material, and the holder comprises an aluminum alloy material.

(7) A rotary grinding tool with reduced noise level according to any one of the above (1) to (6) wherein the sloped surface of the metal disk has a stepped configuration.

(8) A rotary grinding tool with reduced noise level according to any one of the above (1) to (7) wherein the front surface and the sloped surface of the metal disk have a width in radial direction in projected plane seen from the front side of $W_1$ and $W_2$, respectively, and $W_1/W_2$ is greater than 2.0 and $W_2$ is at least 1 mm.

(9) A rotary grinding tool with reduced noise level according to any one of the above (1) to (8) wherein the sloped surface of the metal disk has an area of at least 400 mm$^2$.

(10) A rotary grinding tool with reduced noise level according to any one of the above (1) to (9) wherein a vibration absorber comprising an organic, inorganic, or metal material is provided at least at a part of the boundary or joint between the metal disk and the holder.

(11) A method for producing a rotary grinding tool with reduced noise level according to any one of the above (1) to (10) comprising the steps of coating a filler powder mixed with an organic binder on at least a part of the front surface, the sloped surface, the side surface, and the rear surface of the metal disk to a thickness corresponding to 20 to 60% of the average particle diameter of the hard grains having a Mohs hardness in excess of 9, applying the hard grains having a Mohs hardness in excess of 9 to a surface density of at least 20 grains/cm$^2$, maintaining the metal disk at a reduced pressure of up to $10^{-4}$ Torr at a temperature of 1000 to 1040° C. for 10 to 50 minutes to prepare the metal disk having a grinding surface, and joining the metal disk with the holder to obtain the grinding tool.

Advantageous Effects of Invention

The present invention has enabled to provide an inexpensive rotary grinding tool with excellent noise property with reduced noise in the grinding. In the preferable embodiment, the present invention has also enabled to provide a rotary grinding tool which is capable of grinding both the layered rust and the rust at the corner of structures at a higher efficiency. The present invention has also enabled to provide a method for producing such rotary grinding tool.

DESCRIPTION OF EMBODIMENTS

Next, the present invention is described in detail.

This invention is a rotary grinding tool with reduced noise level comprising a metal disk having a grinding surface on at least a part of its surface and a holder for supporting the metal disk. The grinding surface has hard grains having a Mohs hardness in excess of 9 brazed thereon at a surface density of at least 20 grains/cm$^2$, and the holder has at its center a securing means for securing the holder on rotary shaft of a rotary drive unit. The metal disk is joined to the holder.

Such rotary grinding tool is hereinafter referred to as "the grinding tool of the present invention".

Next, the grinding tool of the present invention is described by referring to FIGS. 1 to 4.

Figure 1:
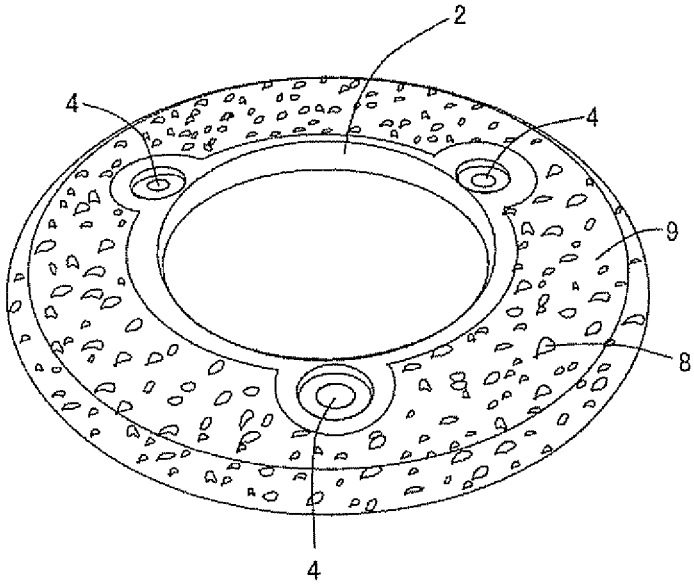
FIG. 1 is a schematic perspective view showing a preferred embodiment of the metal disk having the predetermined hard grains brazed thereon.
Figure 2:
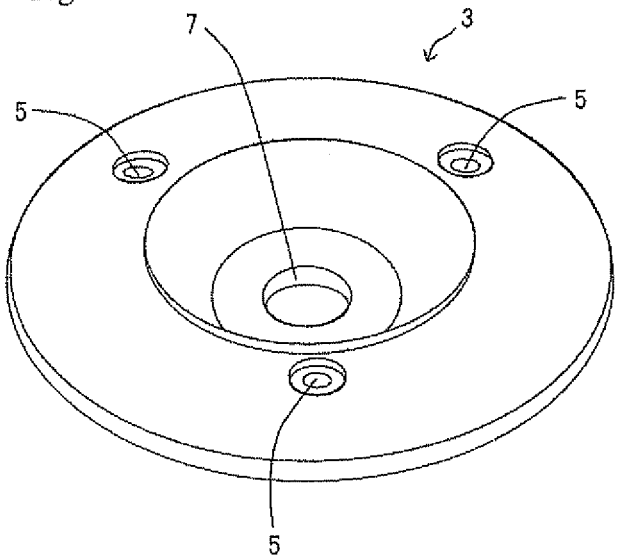
FIG. 2 is a schematic perspective view showing a preferred embodiment of the holder.
Figure 3:
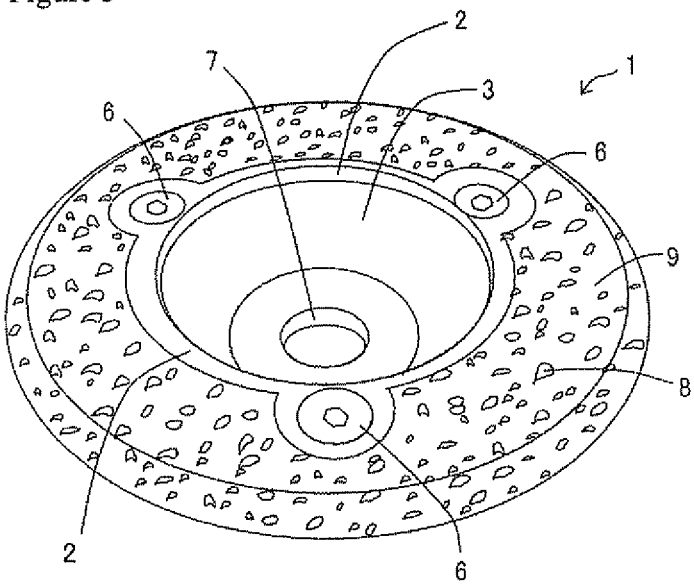
FIG. 3 is a schematic perspective view showing a preferred embodiment of the grinding tool of the present invention.
Figure 4:
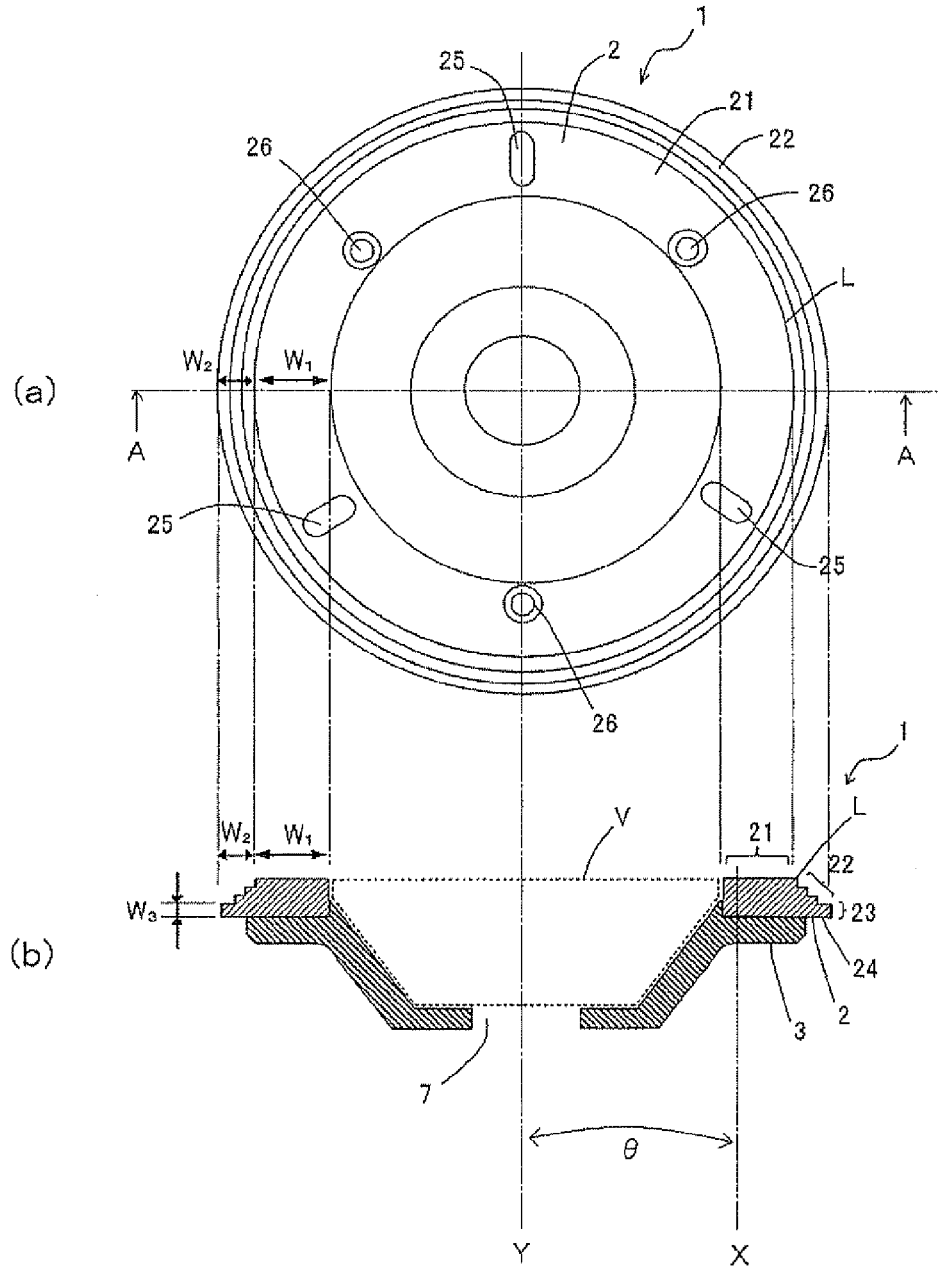
FIG. 4 is a schematic view showing a preferred embodiment of the grinding tool of the present invention, and (a) is a front elevational view, and (b) is a cross-sectional view.

FIG. 1 is a schematic perspective view showing a preferred embodiment of the metal disk 2 having the predetermined hard grains 8 brazed thereon. FIG. 2 is a schematic perspective view showing a preferred embodiment of the holder 3 to be joined to the metal disk 2 for supporting the metal disk 2. FIG. 3 is a schematic perspective view showing a preferred embodiment of the grinding tool 1 of the present invention FIG. 3 comprising the metal disk 2 of FIG. 1 joined to the holder 3 of FIG. 2. FIG. 4 is front elevational view and cross-sectional view of the grinding tool 1 of the present invention shown in FIG. 3.

FIGS. 1 to 4 are views showing preferred embodiments of the grinding tool of the present invention, which by no means limit the scope of the grinding tool of the present invention.

[Metal Disk]

As shown in FIG. 1, the metal disk 2 is a doughnut shaped disk having a circular hole at its center.

The metal disk 2 has the predetermined hard grains 8 brazed on its surface.

The hard grains 8 are those having a Mohs hardness in excess of 9. The part where such hard grains 8 have been brazed on the surface of the metal disk 2 to a surface density of 20/cm$^2$ or higher constitutes the grinding surface 9 in the grinding tool of the present invention 1. The hard grains are described in detail in the following section.

In the grinding tool of the present invention 1, the hard grains are provided not only on the front surface of the metal disk 2 but also on the side surface (peripheral surface). The hard grains are also provided on the side surface and the rear surface (for example, in the peripheral area with a width of about 4 mm on the rear surface) although such grains are not depicted in FIG. 1. Provision of a sufficient amount of hard grains on the side surface is enabled by applying the hard grains also to the rear surface.

The metal disk 2 shown in FIG. 1 has three holes 4 for receiving bolts 6 for securing the metal disk 2 to the holder 3.

[Holder]

As shown in FIG. 2, the holder 3 has a securing means 7 at its center. The securing means 7 is provided for securing the grinding tool 1 of the present invention to the rotary shaft of the rotary drive unit, and in FIG. 2, the securing means is in the form of a securing hole. In other words, the securing hole is the securing means 7 in the grinding tool 1 of the present invention 1.

The holder 3 shown in FIG. 2 also has three holes 5 for receiving bolts used for securing the holder 3 to the metal disk 2 shown in FIG. 1.

[Grinding Tool of the Present Invention]

Preferred embodiment of the grinding tool of the present invention 1 is shown in FIG. 3. The grinding tool comprises the metal disk 2 having predetermined hard grains 8 brazed thereon showing FIG. 1 and the holder 3 shown in FIG. 2, and the metal disk 2 is joined to the holder 3 by three bolts 6.

The grinding tool of the present invention has enabled to remarkably reduce the noise caused in the use of the grinding tool. The inventors of the present invention believe that the slight gap between the metal disk and the holder and the space of certain size or more formed on the front side of the securing means when the metal disk is joined to the holder contribute for the suppression of the noise occurring in the use of the tool.

Provision of a vibration absorber comprising an organic material, an inorganic material, or a metal (namely, a vibration absorber containing at least a member selected from the group consisting of organic material, inorganic material, and metal as its main component) along at least a part of the boundary or joint between the metal disk and the holder is preferable for suppressing of the noise. More specifically, a sheet comprising an organic material such as polyurethane may be sandwiched between the metal disk and the holder. Alternatively, the metal disk and the holder may be joined by using a hexagon socket head cap screw after placing an O-ring comprising an organic material, an inorganic material, or a metal in the recess formed in the front surface of the metal disk.

In the case of the grinding tool of the present invention, the metal disk and the holder are separable, and accordingly, only the metal disk may be replaced with the new metal disk and the holder can by reused in the case of the damage of the metal disk. In contrast, when the metal disk and the holder are inseparable as in the case of conventional grinding tools such as those described in Patent Documents 1 and 2, replacement of the entire grinding tool is necessary when the grinding tool is damaged even if the part corresponding to the holder were undamaged. In the case of the grinding tool of the present invention which allows replacement of solely the metal disk and reuse of the holder, cost of the consumable can be reduced by its use. In addition, formation of the metal disk from stainless steel and the holder from aluminum enables further reduction of the processing and material costs, and anodization of the holder is preferable since anodized aluminum is more resistant to the rust than the stainless steel.

The metal disk is preferably made of stainless steel while use of nickel-based alloy, alloy steel, and steel (plain steel, etc.) is acceptable. Similarly, the holder may preferably comprise an aluminum alloy while use of a copper alloy, a magnesium alloy, and titanium and a titanium alloy is also acceptable.

The head of the bolt may preferably constitute a part of the grinding surface of the grinding tool of the present invention. More specifically, the hard grains are preferably not brazed on the head of the bolt 6 as in the case of the preferred embodiment shown in FIG. 3 in view of the improved impact on the layered rust in the grinding of the layered rust.

While three bolts 6 are used in the grinding tool of the present invention 1 shown in FIG. 3, two to four bolts may be used in the grinding tool of the present invention. However, joining of the metal disk and the holder using three bolts at a regular interval is preferable to simultaneously realize the efficiency of the joining process of the metal disk and the holder and stability of the grinding surface in the use, and particularly, in view of balance of the grinding tool of the present invention which rotates at a high speed. When the hard grains are not brazed on the head of the bolt which constitutes a part of the grinding surface, increase in the number of bolts is associated with the relative decrease of the area of the grinding surface, while presence of such part results in the increase impact to the layered rust in the grinding of the layered rust. Accordingly, use of three bolts is preferable for their balance, and hence, for high grinding efficiency. The holes for the bolts are preferably provided at an equal interval in view of improving the grinding efficiency.

Next, the shape of the grinding tool of the present invention 1 according to a preferable embodiment of FIGS. 1 to 3 is described by referring to FIG. 4. While the grinding tool of the present invention is not particularly limited for its shape, the shape described by referring to FIG. 4 is preferable.

FIG. 4(*a*) is a schematic front elevational view, namely, a view from the side of the front surface, and FIG. 4(*b*) is a cross-sectional view taken along lines A-A of the FIG. 4(*a*). The "view from the side of the front surface" means the view from the side of the front surface seen in a direction parallel to the rotary axis of the grinding tool of the present invention.

For ease of understanding, the predetermined hard grains 8 and the filler material used for the brazing of such hard grains are not depicted in FIG. 4.

In the grinding tool of the present invention 1, the surface of the metal disk 2 includes the front surface 21, the sloped surface 22, the side surface 23, and the rear surface 24, an all of these surfaces have hard grains brazed on at least a part thereof to constitute a part of the grinding surface.

As shown in FIG. 4, the front surface 21, the sloped surface 22, and the side surface 23 are continuously located from the center side to the peripheral (outer) side of the metal disk 2 in this order. The side surface 23 is a surface which is parallel to the rotary axis of the metal disk 2, and therefore, this side surface 23 does not appear in FIG. 4(*a*). The surface found in FIG. 4(*a*) are the front surface 21 and the sloped surface 22. The front surface 21 is the part as defined later, and the sloped surface 22 is the part on the peripheral side of the front surface 21 when the grinding tool of the present invention 1 is viewed from the front surface side (i.e. in FIG. 4(*a*)).

As shown in FIG. 4(*b*), the rear surface 24 is adjacent to the side surface 23, and the rear surface 24 is a surface on the back of the front surface 21 and the sloped surface 22 in the metal disk 2.

[Front Surface]

Next, the front surface of the metal disk is described.

The front surface 21 is a surface perpendicular to rotary axis Y of the grinding tool of the present invention 1.

The "surface perpendicular to the rotary axis" is a part on the surface of the metal disk wherein angle θ between its normal line X and the rotary axis Y is 0 to 5°. The "angle θ between the normal line X and the rotary axis Y" of the front surface 21 is preferably 0 to 2°, more preferably 0 to 1°, and most preferably 0 to 0.5°. The grinding will be more efficient when the angle θ is near 0° since the contact area between the rust and the grinding surface will be greater in the grinding of the layered rust.

When the boundary between the front surface 21 and the sloped surface 22 is designated boundary line L, the boundary line L may also be described as a line where the angle θ between the normal line X of the metal disk surface and the rotary axis Y changes from 5° or less to more than 5°. The front surface 21 may be described as a surface on the central side of the boundary line L and the sloped surface 22 may be described as a surface in the exterior of the boundary line L.

When the sloped surface 22 has a stepped configuration as in the case of FIG. 4, the sloped surface includes "the parts where the angle θ between the normal line X and the rotary axis Y is 0° to 5° (0° in the case shown in FIG. 4)".

When two or more "parts where the angle θ between the normal line X and the rotary axis Y is 0° to 5°" are present in the metal disk, the innermost part (on the side of the rotary axis Y) is designated the front surface, and other planes are designated the sloped surface.

When the sloped surface comprises two or more surfaces as in the case where the cross-section is stepped, the two or more surfaces are together referred to as the sloped surface.

The sloped surface having a stepped cross-section as in the case of the preferred embodiment shown in FIG. 4 is preferable since the hard grains can be firmly brazed.

[Side Surface]

Next, the side surface of the metal disk is described.

The side surface 23 is a surface parallel to the rotary axis Y of the grinding tool of the present invention 1.

In other words, the side surface 23 is the part where the angle θ between the normal line X and the rotary axis Y is 90°.

In the case of the sloped surface 22 having a stepped configuration as shown in FIG. 4, the sloped surface 22 has "the part where the angle θ between the normal line X and the rotary axis Y is 90°". When two or more "parts where the angle θ between the normal line X and the rotary axis Y is 90" are present in the metal disk, the outermost part is the side surface.

[Sloped Surface]

Next, the sloped surface of the metal disk is described.

The sloped surface 22 is the entire surface between the front surface 21 and the side surface 23 as defined above (connecting the front surface and the side surface). The angle between the normal line X of the sloped surface and the rotary axis Y is not particularly limited. This angle, however, will be described later.

[Size of the Surface]

Next, the relation between the size of the front surface and the sloped surface of the metal disk is described by referring to FIG. 4.

FIG. 4(*a*) may also be deemed as a projection (orthographic projection) of the metal disk 2 from the side of the front surface taken in the direction parallel to the rotary axis. When width in radial direction of the projected surface when the front surface 21 is seen from the side of the front surface is designated $W_1$, and similarly, width in radial direction of the projected surface when the sloped surface 22 is seen from the side of the front surface is designated $W_2$ as shown in FIGS. 4(*a*) and 4(*b*), $W_1/W_2$ is greater than 2.0 in the grinding tool 1 according to the preferred embodiment of the present invention.

As described above, in the grinding tool of the present invention, the ratio of $W_1$ to $W_2$ as defined above ($W_1/W_2$) is preferably in excess of 2.0, more preferably at least 3.0, and still more preferably at least 4.0, and most preferably at least 4.5. $W_1/W_2$ is preferably up to 50.0, more preferably up to 10.0, still more preferably up to 7.0, and most preferably up to 5.0.

In the grinding tool 1 according to the preferred embodiment of the present invention, $W_2$ is at least 1 mm.

More specifically, in the grinding tool of the present invention, $W_2$ is preferably at least 1 mm, more preferably at least 2 mm, still more preferably at least 3 mm, and most preferably at least 3.5 mm. $W_2$ is preferably up to 20 mm, more preferably up to 10 mm, and most preferably up to 5 mm.

The grinding tool 1 according to the preferred embodiment of the present invention has a $W_2$ of 1 mm or more which is larger than the conventional tool, and therefore, efficient grinding of the rust at the corner of a structure (for example, boundary between the floor and the wall) is enabled. The sufficiently large $W_1$ compared to the $W_2$ enables efficient grinding of the layered rust.

Due to the sufficiently large $W_2$ and the $W_1/W_2$ as described above, the grinding tool 1 according to the preferred embodiment of the present invention is capable of efficiently grinding the layered rust and the rust at the corner of the structure.

[Angle of the Sloped Surface of the Metal Disk]

Next, angle of the sloped surface of the metal disk is described.

In the grinding tool 1 of the present invention, the sloped surface of the metal disk 2 has stepped cross-section, and determination of the angle of the sloped surface is difficult. Therefore, the value determined as described below is used as the angle θ of the sloped surface of the grinding tool of the present invention.

More specifically, a flat virtual plane is defined between the boundary line between the front surface and the sloped surface of the metal disk (namely, the boundary line L) and the boundary line between the sloped surface and the side surface of the metal disk, and the angle between the normal line X of this plane and the rotary axis Y is designated the angle θ of the metal disk. In the grinding tool of the present invention, the thus determined angle θ is preferably 30 to 80°, more preferably 40 to 70°, still more preferably 40 to 65°, even more preferably 40 to 60°, and most preferably 44 to 46°. Use of the angle within such range enables grinding of the rust at the corner of the structure at a higher efficiency.

[Area of the Sloped Surface of the Metal Disk]

In the grinding tool of the present invention, area of the sloped surface of the metal disk is preferably at least 400 $mm^2$, more preferably at least 1100 $mm^2$, and most preferably at least 1400 $mm^2$, and preferably up to 3000 $mm^2$, more preferably up to 2300 $mm^2$, still more preferably up to 1900 $mm^2$, and most preferably up to 1600 $mm^2$. Use of the area of the sloped surface of the metal disk within such range enables grinding of the rust at the corner of the structure at a higher efficiency.

The area of the sloped surface of the metal disk is determined in a manner similar to the angle as described above by defining a flat virtual plane between the boundary line between the front surface and the sloped surface of the metal disk (namely, the boundary line L) and the boundary line between the sloped surface and the side surface of the metal disk, and determining the area of this plane from the angle θ, $W_2$, radius of the metal disk, width $W_3$ of the side surface of the metal disk, and the like.

[Volume of the Space on the Front Side of the Securing Means]

Next, volume of the space on the front side of the securing means in the grinding tool of the present invention is described.

In the present invention, "the space on the front side of the securing means" is the space defined by surface of the metal disk and the holder in the interior of the front surface of the metal disk in the grinding tool of the present invention, namely, the space V defined in FIG. 4(*b*) by dotted line.

In the present invention, "the space on the front side of the securing means" may have a volume of at least 7000 $mm^3$, more preferably at least 11,000 $mm^3$, and most preferably at least 15,000 $mm^3$ since such volume facilitates more effective suppression of the noise generated in the grinding.

The volume of "the space on the front side of the securing means" is preferably up to 70,000 $mm^3$, more preferably up to 24,000 $mm^3$, still more preferably up to 20,000 $mm^3$, even more preferably up to 18,000 $mm^3$, and most preferably up to 16,000 $mm^3$ since an excessively large volume results in the increase in the size of the rotary drive unit.

In the grinding tool of the present invention, grooves are preferably formed in some parts of the front surface of the metal disk as shown in FIG. 4(*a*). In the preferred embodiment shown in FIG. 4(*a*), three grooves 25 are formed in the front surface 21 of the metal disk 2. When such grooves are formed in the surface, the parts on the grooves in the grinding surface will be recessed from other parts of the surface, and grinding efficiency will be improved by the reason the same as the provision of the bolts as described above. While the groove is not particularly limited for its depth, number, size, and the like, provision of 2 to 4 grooves, and preferably 3 grooves is preferable. The thickness of the groove is preferably 1 to 5 mm, more preferably 1 to 4 mm, still more preferably 1 to 3 mm, and most preferably 1 to 2 mm. As in the case of the bolts, the grooves are preferably formed at a regular interval as shown in FIG. 4(*a*) in view of improved grinding efficiency.

In the grinding tool of the present invention, weight of the metal disk is preferably 100 to 1000 g, more preferably 120 to 700 g, still more preferably 130 to 420 g, and most preferably 140 to 180 g. While the total weight of the metal disk and the holder is not particularly limited, the total weight is preferably 165 to 1065 g, more preferably 185 to 765 g, still more preferably 195 to 485 g, and most preferably 205 to 245 g in view of suppressing the noise in the grinding and improving the impact on the thick rust. While the rotation speed of the grinding tool of the present invention is determined by the specification of the drive unit of the disk grinder drive, the impact depends on the weight of the rotary grinding tool, and a higher weight is more effective. However, the total weight of the metal disk and the holder in excess of 900 g results in an unduly increased rotation moment, and change in the direction of the rotary grinding tool by the operator will be difficult. Accordingly, upper limit of the total weight of the metal disk and the holder is preferably 900 g when the rotary grinding tool is operated by an operator.

Thickness of the metal disk is preferably 3.0 to 6.0 mm, more preferably 3.0 to 5.5 mm, and most preferably 3.3 to 4.0 mm.

Thickness of the holder is preferably 3 to 10 mm, more preferably 3.0 to 6.5 mm, and most preferably 3.3 to 4.0 mm.

The ratio of the contact area between the metal disk and the holder to the area of the metal disk rear surface is preferably within range of 20 to 100%, and the lower limit is more preferably 25%, still more preferably 30%, even more preferably 35%, and most preferably 40%.

When the thickness of the metal disk, thickness of the holder, and the ratio of the contact area between the metal disk and the holder to the area of the metal disk rear surface are within the range as described above, noise in the grinding will be suppressed and impact to the thick rust is also improved.

In the grinding tool of the present invention, the diameter (the outer diameter) of the metal disk is not particularly limited, and the diameter is preferably at least 50 mm, more preferably 90 to 200 mm, still more preferably 100 to 180 mm, even more preferably 100 to 150 mm, and most preferably about 100 mm. Use of such diameter is preferable since the grinding tool having a diameter of such range can be mounted on a commercially available electric rotary drive such as disk grinder drive or hand drill drive. When the diameter is less than 50 mm, mounting of the grinding tool to the electric rotary drive becomes difficult, and removal of thick rust in large area becomes difficult. When the grinding tool can be mounted on a commercially available rotary drive, surface pretreatment for coating can be readily accomplished on site without using the large-scale blasting.

Next, the hard grains brazed on the metal disk surface are described.

The grinding tool of the present invention has the hard grains having a Mohs hardness in excess of 9 brazed on at least some parts of the metal disk surface at a surface density of 20 grains/$cm^2$.

When the surface density is within such range, grinding can be continued even if some hard grains fall off the metal disk, and the tool can be used for a prolonged period as in the case of the grinding of a large area. The hard grains having a Mohs hardness in excess of 9 is preferably brazed to a surface density of 30 grains/$cm^2$ or more for improving the grinding efficiency of a large surface area. However, the surface density of 60 grains/$cm^2$ or more leads to increase in the cost, and provision of the hard grains at a surface density of 100 grains/$cm^2$ or more is difficult in view of the space. Accordingly, the preferred is the surface density of about 30 grains/$cm^2$ to 60 grains/$cm^2$.

The surface density may be determined by counting the number of hard grains in any area of 10 mm×10 mm.

In the grinding tool of the present invention, the hard grains having a Mohs hardness in excess of 9 is brazed on the metal disk surface because Mohs hardness of the rust firmly bonded to the surface is in excess of 9, and the rust removal is difficult when the hard grains are corundum or alumina having a Mohs hardness of 9 which is abraded by the firm rust.

The type of the hard grains is not particularly limited as long as the Mohs hardness is in excess of 9. In view of efficient removal of the firm rust, use of diamond or cubic boron nitride is preferable.

The hard grains may have an average grain diameter of at least 200 μm and up to 1000 μm. Use of the hard grains with the average grain diameter of 200 μm or more is less likely to cause clogging which may result in the loss of grinding performance. The average grain diameter of up to 1000 μm enables increase in the surface density of the grains, namely, improved performance for an extended time. Increase in the cost of the industrial diamond with the increase in the diameter was also considered. As a result of trying various diameters, use of the hard grains having an average diameter of 300 μm to 950 μm has been found preferable, and production of the grinding tool using industrial diamond or cubic boron nitride having a diameter distribution of 650 μm to 900 μm has been found efficient. Cubic boron nitride, however, is more likely to experience grain breakage compared to diamond, and longer use of the grinding tool with higher operability is enabled by the use of the diamond.

The average grain diameter of the hard grains may be determined by randomly collecting 50 hard grains before the brazing, measuring the diameter with a caliper, and calculating the simple average.

The braze alloy (filler material) used for the brazing of the hard grains is not particularly limited as long as it is capable of sufficiently bonding the hard grains having a Mohs hardness in excess of 9 to the surface of the metal disk, and the braze alloy (filler material) may be adequately selected depending on the materials used for the hard grains and the metal disk. The base ingredient of the filler material may be selected from nickel brazing fillers defined in JIS Z 3265, silver brazing fillers defined in JIS Z 3261, copper and brass brazing fillers defined in JIS Z 3262, aluminum alloy brazing fillers and brazing sheet defined in JIS Z 3263, phosphor copper brazing fillers defined in JIS Z 3264, gold brazing fillers defined in JIS Z 3266, palladium brazing fillers defined in JIS Z 3267, brazing filler metals for vacuum service defined in JIS Z 3268, and various solders defined in JIS 3282.

Of the filler materials as described above, the preferred are nickel-base filler materials (such as BNi-1, BNi-1A, BNi-2, BNi-5, and BNi-7) in view of the melting point and the like. For improved bonding with the hard grains of diamond, cubic boron nitride, and the like, use of a filler material supplemented with at least one of titanium, chromium, and zirconium at an amount of 0.5% by weight or more is preferable.

Bonding strength of the hard grains having a Mohs hardness of 9 or more to the metal disk is improved when a filler material containing at least one of titanium, chromium, and zirconium at an amount of 0.5% by weight or more is used for the filler material and a stainless steel is used for the material constituting the metal disk since mesophase is formed by the metallurgic reaction at each boundary between the hard grains, the metal disk, and the filler material. This combination of the materials is effective for realizing a shear strength of 20 N/grain or higher of the hard grains having a Mohs hardness of 9 or higher as described below. For firm bonding of the hard grains of diamond or cubic boron nitride using a nickel filler material containing at least one of titanium, chromium, and zirconium, the filler material should also be firmly bonded to the metal disk, and use of a nickel filler material containing at least one of titanium, chromium, and zirconium which is highly compatible with the stainless steel enables firm bonding by alloying. When an austenitic stainless steel such as SUS304 is used for the metal disk, the hard grains will be firmly bonded, and use of such material is also advantageous for improving the corrosion resistance of the grinding tool which is often used for removing thick rust of a steel material in salt damage environment.

As described above, the grinding tool of the present invention has a part where the hard grains are brazed on the metal disk surface by using a braze alloy (filler material), and more specifically, the part prepared by coating the filler material on the metal disk surface to a thickness corresponding to 20 to 60% of the average grain size of the hard grains, and applying the hard grains. Accordingly, at the grinding surface of the grinding tool of the present invention, the hard grains are partly exposed with the remaining portion embedded in the braze alloy (filler material).

Preferably, the hard grains are bonded to the filler material so that average shear strength of the brazed hard grains is at least 20 N/grain. For example, when the diamond having a Mohs hardness of 10 collides with the surface of a steel workpiece at a high speed, the diamond is often broken by thermal fatigue, and due to the insufficient countermeasure, the entire hard grains (abrasive grain) often became removed from the disk and grinding of the steel surface often resulted in the short life of the grinding tool. However, when the average shear strength of the brazed hard grain is 20 N/grain, the hard grains (diamond) does not fall off the grinding surface even if the grain is broken by thermal fatigue, and the grinding operation can be continued. In other words, the shear strength is an index for evaluating bonding strength of the hard grains with the filler material. The shear strength is measured by placing the metal disk having the hard grains brazed thereon on the stage, holding the exposed part of the hard grain by a hard hooked tool connected to the load cell, and applying load to the stage in transverse direction to thereby find the load when the hard grain is separated from the filler material. For example, the shear strength may be measured by using a bonding tester manufactured by Resca.

In the present invention, the average shear strength is the one obtained by measuring shear strength of the hard grain for any 20 or more hard grains present in the area of 10 mm×10 mm (1 $cm^2$), and calculating the average.

In view of realizing a high average shear strength of 20 N/grain on average, the filler material used is preferably an alloy containing at least 0.5% by weight of at least one member selected from titanium, chromium, and zirconium as described above. Exemplary preferable filler materials (braze alloys) include Ag (70% by weight)-Cu (28% by weight)-Ti (2% by weight) alloy, Ni (74% by weight)-Cr (14% by weight)-B (3% by weight)-Si (4% by weight)-Fe (4.3% by weight)-C (0.7% by weight) alloy, Ni (83% by weight)-Cr (7% by weight)-B (3% by weight)-Si (4% by weight)-Fe (3% by weight) alloy, Ni (71% by weight)-Cr (19% by weight)-Si (10% by weight) alloy, and Ni (77% by weight)-P (10% by weight)-Cr (13% by weight) alloy.

Next, the method for producing the grinding tool of the present invention is described.

The method used for producing the grinding tool of the present invention is not particularly limited. However, in a preferred embodiment, the grinding tool is prepared by coating the surface of the metal disk (namely, at least a part of the front surface, the sloped surface, the side surface, and the rear surface) with a brazing powder mixed with an organic binder to a thickness corresponding to 20 to 60% of the average grain diameter of the hard grains having a Mohs hardness in excess of 9, applying the hard grains having a Mohs hardness in excess of 9 into the coating to a surface density of at least 20 grains/cm$^2$, maintaining the metal disk at a reduced pressure of up to $10^{-4}$ Torr at a temperature of 1000 to 1040° C. for 10 to 50 minutes to prepare a metal disk having a grinding surface, and joining the metal disk with the holder to obtain the grinding tool of the present invention. More preferably, the metal disk and the holder are bonded to each other by using 2 to 4 bolts.

More preferably, the brazing powder is coated to a thickness corresponding to 25 to 35% of the average grain diameter, and maintaining the metal disk at a pressure of less than $10^{-5}$ Torr and at a temperature of 1010 to 1030° C. for 25 to 35 minutes.

EXAMPLES

Example 1

The rotary grinding tools of the embodiments shown in FIGS. 1 to 4 were produced.

First, the metal disk and the holder shown in FIGS. 1 and 2 were prepared. The metal disk is a doughnut-shaped disk of SUS304 having an outer diameter (diameter) of 100 mm and an inner diameter (diameter) of 54.2 mm. The holder is made from A5052 which is an Al—Mg alloy, and the surface of the holder is anodized. The holder has an outer diameter (diameter) of 80 mm, and a diameter of the securing hole of 15 mm.

Next, a paste prepared by mixing an organic binder with the filler material powder was coated on the front surface, the sloped surface (stepped surface), the side surface, and the rear surface of the metal disk for the brazing of industrial diamond grains having an average grain diameter of 800 μm (standard deviation, 40 μm). The filler material used was BNi-2, and polyvinyl alcohol was used for the organic binder. The paste was coated to a thickness corresponding to 40% of the average grain diameter of the diamond grains. The average grain diameter of the industrial diamond grains was determined by randomly collecting 50 hard grains before the brazing, measuring their diameter by a caliper, and calculating simple average.

The industrial diamond grains were applied on the coated paste at a surface density of 35 grains/cm$^2$, and the disk was maintained in an atmosphere of $10^{-5}$ Torr at a temperature of 1020° C. for 30 minutes to prepare a metal disk having the grinding surface.

Next, the thus obtained metal disk and the holder were joined using 3 hexagon socket head cap screws.

The rotary grinding tool of the present invention was thereby obtained. The resulting rotary grinding tool is hereinafter referred to as the "rotary grinding tool 1". This applies to the following examples, and in the Example 2, for example, the resulting rotary grinding tool is referred the "rotary grinding tool 2".

The specifications of the resulting rotary grinding tool 1 were as described below:

Angle θ between the normal line X of the front surface and the rotary axis Y of the metal disk: 0°

Volume of the space on the front side of the securing means (V): 15420 mm$^3$

Thickness of the metal disk: 3.5 mm

Weight of the metal disk: 160 g

Thickness of the holder: 3.5 mm

Contact area percentage of the metal disk and the holder (percentage of the contact area of the metal disk with the holder in relation to the total area of the rear surface of the metal disk): 40%

Configuration of the sloped surface of the metal disk: stepped (3 steps as in the case of FIG. 4 each step having a height of about 1 mm)

$W_1$: 19 mm $W_2$: 3.9 mm $W_1/W_2$-4.87

$W_3$: 1.0 mm

Area of the sloped surface of the metal disk: 1490 mm$^2$

Next, noise and rust grinding efficiency were measured to determine the performance of the thus produced rotary grinding tool 1.

First, salt water was sprayed on the surface of a weathering steel (JIS G3114 SMA490) to prepare a test piece having layered rust developed to a thickness of about 1.5 mm. The layered rust was high density with reduced number of pitting.

Next, the rotary grinding tool 1 was mounted on a disk grinder drive, and rust removal was conducted for 4 hours so that percentage of the matrix-exposed area of the test piece was about 70%, and the area of the thus exposed area was measured to thereby calculate the rust grinding efficiency (minute/m$^2$). The noise (dB) was measured at a position 5 m away from the operation.

The results of the measurements of the noise and the rust grinding efficiency are shown in the column of "Example 1" in Table 1 together with the specifications of the particular embodiment of the rotary grinding tool 1.

Example 2

The procedure of Example 1 was repeated except that the sloped surface of the metal disk having the stepped cross-section was replaced with the sloped surface having a conical configuration. The thus prepared rotary grinding tool 2 was tested by repeating the procedure of Example 1.

The results of the measurements of the noise and the rust grinding efficiency are shown in the column of "Example 2" in Table 1 together with the specifications of the particular embodiment of the rotary grinding tool 2.

Example 3

The procedure of Example 1 was repeated except that the industrial diamond used in Example 1 was replaced with cubic boron nitride (CBN) having an average grain diameter of 750 (with the standard deviation of 50 μm). The thus prepared rotary grinding tool 3 was tested by repeating the procedure of Example 1.

The results of the measurements of the noise and the rust grinding efficiency are shown in the column of "Example 3" in Table 1 together with the specifications of the particular embodiment of the rotary grinding tool 3.

Example 4

The procedure of Example 1 was repeated except that the surface density of the industrial diamond of 35 grains/cm$^2$ in Example 1 was replaced with 21 grains/cm$^2$. The thus prepared rotary grinding tool 4 was tested by repeating the procedure of Example 1.

The results of the measurements of the noise and the rust grinding efficiency are shown in the column of "Example 4"

in Table 1 together with the specifications of the particular embodiment of the rotary grinding tool 4.

Example 5

The procedure of Example 1 was repeated except that the metal disk having a thickness of 3.5 mm and a weight of 160 g used in Example 1 was replaced with a metal disk (of the same material) having a thickness of 3.0 mm and a weight of 145 g. The thus prepared rotary grinding tool 5 was tested by repeating the procedure of Example 1.

The results of the measurements of the noise and the rust grinding efficiency are shown in the column of "Example 5" in Table 1 together with the specifications of the particular embodiment of the rotary grinding tool 5.

Example 6

The procedure of Example 1 was repeated except that the holder having a thickness of 3.5 mm used in Example 1 was replaced with a holder (of the same material) having a thickness of 9.5 mm. The thus prepared rotary grinding tool 6 was tested by repeating the procedure of Example 1.

The results of the measurements of the noise and the rust grinding efficiency are shown in the column of "Example 6" in Table 1 together with the specifications of the particular embodiment of the rotary grinding tool 6.

Example 7

The procedure of Example 1 was repeated except that the holder having a thickness of 3.5 mm used in Example 1 was replaced with a holder (of the same material) having a thickness of 6.0 mm. The thus prepared rotary grinding tool 6 was tested by repeating the procedure of Example 1.

The results of the measurements of the noise and the rust grinding efficiency are shown in the column of "Example 7" in Table 1 together with the specifications of the particular embodiment of the rotary grinding tool 7.

Example 8

The procedure of Example 1 was repeated except that the holder having a thickness of 3.5 mm used in Example 1 was replaced with a holder (of the same material) having a thickness of 6.0 mm, and that this resulted in the volume of the space on the front side of the securing means of 9540 $mm^3$ instead of 15420 $mm^3$ in Example 1. The thus prepared rotary grinding tool 8 was tested by repeating the procedure of Example 1.

The results of the measurements of the noise and the rust grinding efficiency are shown in the column of "Example 8" in Table 1 together with the specifications of the particular embodiment of the rotary grinding tool 8.

Example 9

The procedure of Example 1 was repeated except that the metal disk having a thickness of 3.5 mm and a weight of 160 g used in Example 1 was replaced with a metal disk (of the same material) having a thickness of 5.5 mm and a weight of 200 g, and that this resulted in the volume of the space on the front side of the securing means of 17420 $mm^3$ instead of 15420 $mm^3$ in Example 1 and the area of the sloped surface of the metal disk of 1830 $mm^2$ instead of 1490 $mm^2$ in Example 1. The thus prepared rotary grinding tool 9 was tested by repeating the procedure of Example 1.

The results of the measurements of the noise and the rust grinding efficiency are shown in the column of "Example 9" in Table 1 together with the specifications of the particular embodiment of the rotary grinding tool 9.

Example 10

The procedure of Example 1 was repeated except that an O-ring was inserted in the recesses provided on the front surface of the metal disk before joining the metal disk with the holder by using hexagon socket head cap screws. The thus prepared rotary grinding tool 10 was tested by repeating the procedure of Example 1. The O-ring was a silicone rubber O-ring, and the O-ring was used for each of the three joints. The ratio (percentage) of the contact area between the O-ring and the metal disk in relation to the contact area between the metal disk and the holder (the contact area between the metal disk and the holder in the embodiment of Example 1) was 6%.

The results of the measurements of the noise and the rust grinding efficiency are shown in the column of "Example 10" in Table 1 together with the specifications of the particular embodiment of the rotary grinding tool 10.

Example 11

The procedure of Example 1 was repeated except that a polyurethane rubber sheet (thickness, 1 mm) was sandwiched between the metal disk and the holder before the joining of the metal disk and the holder by using hexagon socket head cap screws. The thus prepared rotary grinding tool 11 was tested by repeating the procedure of Example 1. The area (size) of the major surface of the polyurethane rubber sheet is the same as the contact area of the metal disk and the holder in Example 1. More specifically, the ratio (percentage) of the contact area between the polyurethane rubber sheet and the metal disk in relation to the contact area between the metal disk and the holder (the contact area between the metal disk and the holder in the embodiment of Example 1) was 100%.

The results of the measurements of the noise and the rust grinding efficiency are shown in the column of "Example 11" in Table 1 together with the specifications of the particular embodiment of the rotary grinding tool 11.

Example 12

The procedure of Example 11 was repeated except that a copper sheet having a thickness of 0.5 mm was used instead of the polyurethane rubber sheet used in Example 11. The thus prepared rotary grinding tool 12 was tested by repeating the procedure of Example 11.

The results of the measurements of the noise and the rust grinding efficiency are shown in the column of "Example 12" in Table 1 together with the specifications of the particular embodiment of the rotary grinding tool 12.

Example 13

The procedure of Example 11 was repeated except that a #240 SiC paper was used instead of the polyurethane rubber sheet used in Example 11. The thus prepared rotary grinding tool 13 was tested by repeating the procedure of Example 11.

The results of the measurements of the noise and the rust grinding efficiency are shown in the column of "Example 13" in Table 1 together with the specifications of the particular embodiment of the rotary grinding tool 13.

Example 14

The procedure of Example 1 was repeated except that the metal disk having a diameter of 100 mm, a weight of 160 g, and $W_1$ of 19 mm ($W_1/W_2$=4.87) used in Example 1 was replaced with a metal disk (of the same material) having a diameter of 150 mm, a weight of 413 g, and $W_1$ of 33 mm ($W_1/W_2$=8.46), and that this resulted in the volume of the space on the front side of the securing means of 65425 $mm^3$ instead of 15420 $mm^3$ in Example 1, the area of the sloped surface of the metal disk of 2235 $mm^2$ instead of 1490 $mm^2$ in Example 1, and the contact area between the metal disk and the holder of 30% instead of 40% in Example 1. The thus prepared rotary grinding tool 14 was tested by repeating the procedure of Example 1.

The results of the measurements of the noise and the rust grinding efficiency are shown in the column of "Example 14" in Table 1 together with the specifications of the particular embodiment of the rotary grinding tool 14.

Example 15

The procedure of Example 1 was repeated except that the metal disk having a diameter of 100 mm, a weight of 160 g, and $W_1$ of 19 mm ($W_1/W_2$=4.87) used in Example 1 was replaced with a metal disk (of the same material) having diameter 180 mm, a weight of 667 g, and $W_1$ of 166 mm ($W_1/W_2$=42.5), and that this resulted in the volume of the space on the front side of the securing means of 65425 $mm^3$ instead of 15420 $mm^3$ in Example 1, the area of the sloped surface of the metal disk of 2682 $mm^2$ instead of 1490 $mm^2$ in Example 1, and the contact area between the metal disk and the holder of 20% instead of 40% in Example 1. The thus prepared rotary grinding tool 15 was tested by repeating the procedure of Example 1.

The results of the measurements of the noise and the rust grinding efficiency are shown in the column of "Example 15" in Table 1 together with the specifications of the particular embodiment of the rotary grinding tool 15.

Example 16

The procedure of Example 1 was repeated except that the stainless steel metal disk (SUS304) was replaced with a plain steel metal disk to prepare a rotary grinding tool 16. The rotary grinding tool 16 was evaluated as in the case of Example 1.

The results of the measurements of the noise and the rust grinding efficiency are shown in the column of "Example 16" in Table 1 together with the specifications of the particular embodiment of the rotary grinding tool 16.

Comparative Example 1

Figure 5:
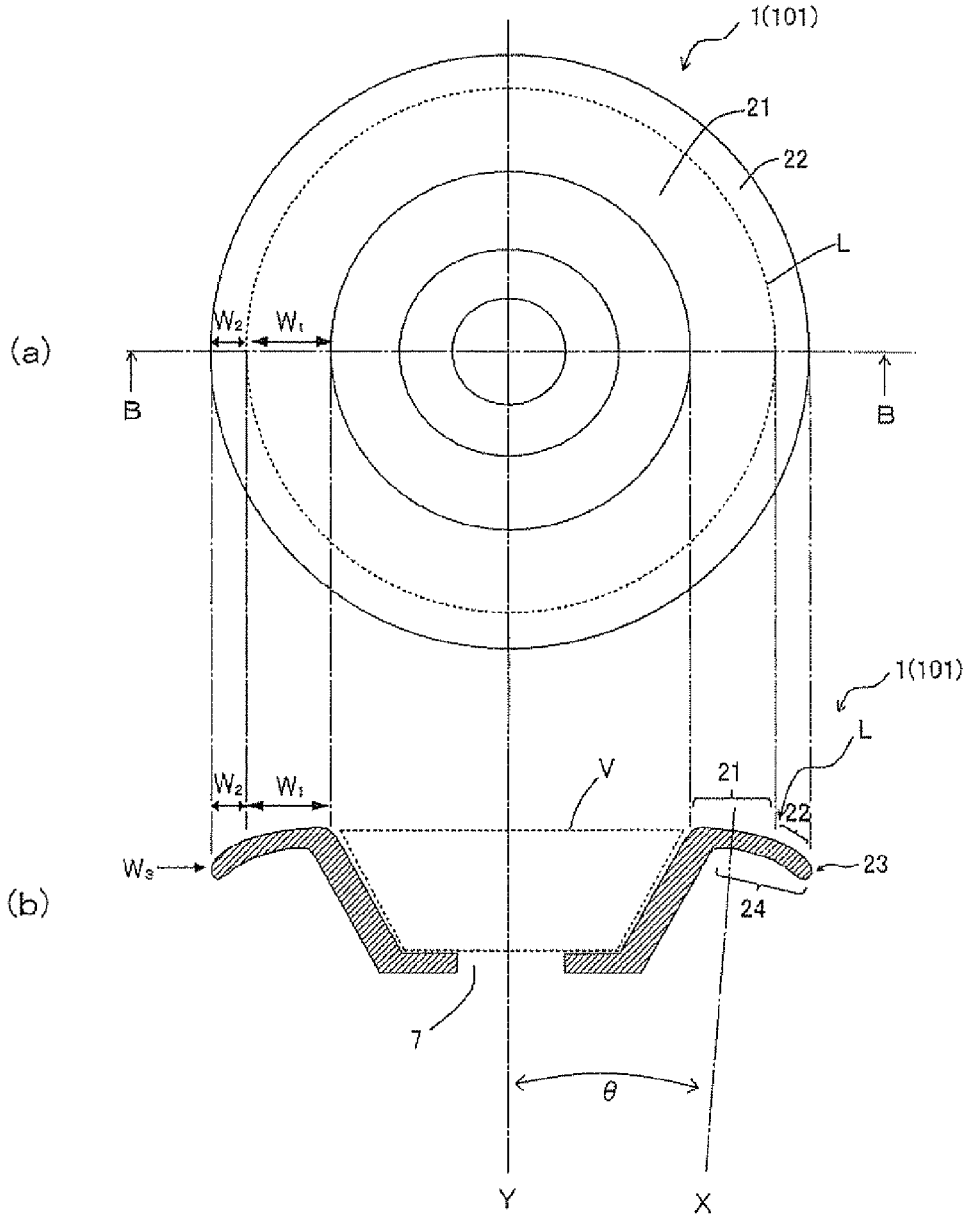
FIG. 5 is a schematic view showing a comparative example of the grinding tool in contrast to the grinding tool of the present invention, and (a) is a front elevational view, and (b) is a cross-sectional view.

Next, a rotary grinding tool of the embodiment shown in FIG. 5 was produced as a Comparative Example. FIG. 5 shows a conventional rotary grinding tool known in the art, and the metal disk and the holder are not separate. FIG. 5(*a*) is a schematic front elevational view, and FIG. 5(*b*) is a cross-sectional view taken along lines B-B in FIG. 5(*a*). For ease of understanding, the predetermined hard grains and the filler material used for the brazing of such hard grains are not depicted in FIG. 5. FIG. 5, the same numerals are used for the parts corresponding to the grinding tool of the present invention shown in FIG. 4.

First, a metal rotary disk shown in FIG. 5 was prepared. The metal rotary disk was made of SUS304 as in the case of Example 1, and it had an outer diameter (diameter) of 100 mm, an inner diameter (inner diameter of the doughnut-shaped surface formed by the front surface 21) of 54.2 mm, and a diameter of the securing hole of 15 mm.

Next, industrial diamond grains were brazed as in the case of Example 1 to a surface density of 25 grains/$cm^2$.

A rotary grinding tool was thereby prepared. The rotary grinding tool prepared in this Comparative Example 1 is hereinafter referred to as a "rotary grinding tool 101". Similarly, the rotary grinding tools prepared in Comparative Examples 2 and 3 are referred to as a "rotary grinding tool 102" and a "rotary grinding tool 103".

The specifications of the resulting rotary grinding tool 101 were as described below:

Angle θ between the normal line X of the front surface and the rotary axis Y of the metal disk: in excess of 5° and up to 10°

Volume of the space on the front side of the securing means (V): 3746 $mm^3$

Thickness of the metal disk: 3 to 5 mm

Weight of the metal disk: 270 g

Shape of the part corresponding to the "sloped surface" of metal rotary disk: curved $W_1$: 8 mm $W_2$: 27 mm $W_1/W_2$=0.3

$W_3$: 0 mm ($W_3$ is a point when seen in cross-section of FIG. 5(*b*))

Area of the part corresponding to the "sloped surface" of metal rotary disk: 6468 $mm^2$ Next, the noise and the rust grinding efficiency were measured by repeating the procedure of Example 1 to evaluate performance of the resulting rotary grinding tool 101.

The results of the measurements of the noise and the rust grinding efficiency are shown in the column of "Comparative Example 1" in Table 1 together with the specifications of the particular embodiment of the rotary grinding tool 101.

Comparative Example 2

A metal rotary disk similar to the embodiment of Comparative Example 1 was prepared. The metal rotary disk produced was different from the rotary grinding tool 101 of Comparative Example 1 in the surface density of the industrial diamond grains (5 grains/$cm^2$), the angle θ between the normal line X of the front surface and the rotary axis Y of the metal disk (0°), the volume of the space on the front side of the securing means (V) (15520 $mm^3$), the thickness of the metal rotary disk (2 mm), the weight of the metal rotary disk (150 g), the material of the metal rotary disk (plain steel), the $W_1$ (1152 mm), the $W_2$ (24 mm), the $W_1/W_2$ (48), and the area of the sloped surface of the metal rotary disk (300 $mm^2$).

Next, the noise and the rust grinding efficiency were measured by repeating the procedure of Example 1 to evaluate performance of the resulting rotary grinding tool 102.

The results of the measurements of the noise and the rust grinding efficiency are shown in the column of "Comparative Example 2" in Table 1 together with the specifications of the particular embodiment of the rotary grinding tool 102.

Comparative Example 3

A metal rotary disk similar to the embodiment of Comparative Example 1 was prepared. The metal rotary disk produced was different from the rotary grinding tool 101 of Comparative Example 1 in the surface density of the industrial diamond grains (5 grains/$cm^2$), the volume of the space on the front side of the securing means (3000 $mm^3$), the thickness of the metal rotary disk (2 mm), the weight of the metal rotary disk (145 g), the material of the metal rotary disk (plain steel), the $W_1$ (10.4 mm), the $W_2$ (26 mm), the $W_1/W_2$ (0.4), and the area of the sloped surface of the metal rotary disk (6000 $mm^2$).

Next, the noise and the rust grinding efficiency were measured by repeating the procedure of Example 1 to evaluate performance of the resulting rotary grinding tool 103.

The results of the measurements of the noise and the rust grinding efficiency are shown in the column of "Comparative Example 3" in Table 1 together with the specifications of the particular embodiment of the rotary grinding tool 103.

TABLE 1

| | Ex. 1 | Ex. 2 | Ex. 3 | Ex. 1 | Ex. 5 | Ex. 6 | Ex. 7 | Ex. 8 | Ex. 9 |
|---|---|---|---|---|---|---|---|---|---|
| Diameter | 100 | 100 | 100 | 100 | 100 | 100 | 100 | 100 | 100 |
| Type of the hard grains | Industrial diamond | Industrial diamond | CBN | Industrial diamond | Industrial diamond | Industrial diamond | Industrial diamond | Industrial diamond | Industrial diamond |
| Surface density of the hard grains (grains/cm$^2$) | 35 | 35 | 35 | 21 | 35 | 35 | 35 | 35 | 35 |
| Metal disk - holder joining | Yes | Yes | Yes | Yes | Yes | Yes | Yes | Yes | Yes |
| Securing means in the holder | Yes | Yes | Yes | Yes | Yes | Yes | Yes | Yes | Yes |
| Angle between the front surface and rotary axis | 90° | 90° | 90° | 90° | 90° | 90° | 90° | 90° | 90° |
| Bolt at the metal disk - holder joint | Yes | Yes | Yes | Yes | Yes | Yes | Yes | Yes | Yes |
| Volume of the space on the front side of the securing means (mm$^3$) | 15420 | 15420 | 15420 | 15420 | 15420 | 15420 | 15420 | 9540 | 17420 |
| Metal disk thickness (mm) | 3.5 | 3.5 | 3.5 | 3.5 | 3 | 3.5 | 3.5 | 3.5 | 5.5 |
| Metal disk weight (g) | 160 | 160 | 160 | 160 | 145 | 160 | 160 | 160 | 200 |
| Holder thickness (mm) | 3.5 | 3.5 | 3.5 | 3.5 | 3.5 | 9.5 | 6 | 6 | 4 |
| Contact area (%) at the holder - metal disk boundary | 40 | 40 | 40 | 40 | 40 | 40 | 40 | 40 | 40 |
| Material of the metal disk | Stainless steel | Stainless steel | Stainless steel | Stainless steel | Stainless steel | Stainless steel | Stainless steel | Stainless steel | Stainless steel |
| Material of the holder | Al alloy | Al alloy | Al alloy | Al alloy | Al alloy | Al alloy | Al alloy | Al alloy | Al alloy |
| Shape of the metal disk sloped surface | Stepped (1 mm) | Conical | Stepped (1 mm) | Stepped (1 mm) | Stepped (1 mm) | Stepped (1 mm) | Stepped (1 mm) | Stepped (1 mm) | Stepped (1 mm) |
| $W_2$ (mm) | 3.9 | 3.9 | 3.9 | 3.9 | 3.9 | 3.9 | 3.9 | 3.9 | 3.9 |
| $W_1/W_2$ | 4.87 | 4.87 | 4.87 | 4.87 | 4.87 | 4.87 | 4.87 | 4.87 | 4.87 |
| Area of the metal disk sloped surface (mm$^2$) | 1490 | 1490 | 1490 | 1490 | 1490 | 1490 | 1490 | 1490 | 1830 |
| Vibration absorber at the metal disk - holder boundary | — | — | — | — | — | — | — | — | — |
| Specification of the vibration absorber | — | — | — | — | — | — | — | — | — |
| Area ratio (%) of the vibration absorber to the metal disk | — | — | — | — | — | — | — | — | — |
| Noise measurement (dB) | 88.5 | 88.5 | 87.6 | 89 | 88.5 | 84.2 | 84.5 | 89.2 | 84.5 |
| Rust grinding efficiency (min/m$^2$) | 18 | 31 | 23 | 19 | 18 | 18 | 18 | 23 | 17 |

| | Ex. 10 | Ex. 11 | Ex. 12 | Ex. 13 | Ex. 14 | Ex. 15 | Ex. 16 | Comp. Ex. 1 | Comp. Ex. 2 | Comp. Ex. 3 |
|---|---|---|---|---|---|---|---|---|---|---|
| Diameter | 100 | 100 | 100 | 100 | 150 | 180 | 100 | 100 | 100 | 100 |
| Type of the hard grains | Industrial diamond | Industrial diamond | Industrial diamond | Industrial diamond | Industrial diamond | Industrial diamond | Industrial diamond | Industrial diamond | Industrial diamond | Industrial diamond |
| Surface density of the hard grains (grains/cm$^2$) | 35 | 35 | 35 | 35 | 35 | 35 | 35 | 25 | 5 | 5 |
| Metal disk - holder joining | Yes | Yes | Yes | Yes | Yes | Yes | Yes | No | No | No |
| Securing means in the holder | Yes | Yes | Yes | Yes | Yes | Yes | Yes | No holder | No holder | No holder |
| Angle between the front surface and rotary axis | 90° | 90° | 90° | 90° | 90° | 90° | 90° | 5°>, ≤10 | 90° | 5°>, ≤10 |
| Bolt at the metal disk - holder joint | Yes | Yes | Yes | Yes | Yes | Yes | Yes | No | No | No |

TABLE 1-continued

| | | | | | | | | | | |
|---|---|---|---|---|---|---|---|---|---|---|
| Volume of the space on the front side of the securing means ($mm^3$) | 15420 | 15420 | 15420 | 15420 | 65425 | 65425 | 15420 | 3746 | 15520 | 3000 |
| Metal disk thickness (cm) | 3.5 | 3.5 | 3.5 | 3.5 | 3.5 | 3.5 | 3.5 | 3-5 | 2 | 2 |
| Metal disk weight (g) | 160 | 160 | 160 | 160 | 413 | 667 | 160 | 270 | 150 | 145 |
| Holder thickness (mm) | 3.5 | 3.5 | 3.5 | 3.5 | 3.5 | 3.5 | 3.5 | No holder | No holder | No holder |
| Contact area (%) at the holder - metal disk boundary | 40 | 40 | 40 | 40 | 30 | 20 | 40 | No holder | No holder | No holder |
| Material of the metal disk | Stainless steel | Stainless steel | Stainless steel | Stainless steel | Stainless steel | Stainless steel | Normal steel | Stainless steel | Normal steel | Normal steel |
| Material of the holder | Al alloy | Al alloy | Al alloy | Al alloy | Al alloy | Al alloy | Al alloy | No holder | No holder | No holder |
| Shape of the metal disk sloped surface | Stepped (1 mm) | Stepped (1 mm) | Stepped (1 mm) | Stepped (1 mm) | Stepped (1 mm) | Stepped (1 mm) | Stepped (1 mm) | Curved | Curved | Curved |
| $W_2$ (mm) | 3.9 | 3.9 | 3.9 | 3.9 | 3.9 | 3.9 | 3.9 | 27 | 24 | 26 |
| $W_1/W_2$ | 4.87 | 4.87 | 4.87 | 4.87 | 8.46 | 42.5 | 4.87 | 0.3 | 48 | 0.4 |
| Area of the metal disk sloped surface ($mm^2$) | 1490 | 1490 | 1490 | 1490 | 2235 | 2682 | 1490 | 6468 | 300 | 6000 |
| Vibration absorber at the metal disk - holder boundary | Yes | Yes | Yes | Yes | No | No | No | No holder | No holder | No holder |
| Specification of the vibration absorber | Silicone rubber O-ring × 3 | Poly-urethane rubber sheet (1 mm) | Copper sheet (0.5 mm)- | #240 Sic paper | — | — | — | No holder | No holder | No holder |
| Area ratio (%) of the vibration absorber to the metal disk | 6 | 100 | 100 | 100 | — | — | — | No holder | No holder | No holder |
| Noise measurement (dB) | 83.8 | 82.8 | 87.8 | 84.6 | 89.5 | 88.5 | 87.5 | 100.5 | 101.5 | 102.2 |
| Rust grinding efficiency ($min/m^2$) | 18 | 18 | 18 | 18 | 11 | 8 | 22 | 43 | 76 | 115 |

As shown in Table 1, when the test piece is grinded by using the rotary grinding tools 1 to 16 of the Examples 1 to 16 which are the grinding tools of the present invention, the noise was as low as less than 90 dB. More specifically, the noise was at the low level of less than 85 dB when the holder was thick (Examples 6 and 7), the volume of the space on the front side was large (Example 9), and the vibration absorber comprising an organic material was disposed between the metal disk and the holder (Examples 10, 11, and 13).

In contrast, the noise was in excess of 100 dB in the case of the conventional known rotary grinding tools 101 to 103 of the Comparative Examples 1 to 3 which are inseparable into the metal disk and the holder.

As described above, clear difference in the noise during the grinding was confirmed between the Examples and the Comparative Examples.

Such reduced noise in the grinding of the test piece in the cases of the rotary grinding tools 1 to 16 of the present invention should have been the result of the grinding tool of the present invention which had been prepared by joining the metal disk and the holder.

As shown in Table 1, when the test piece was grinded by using the rotary grinding tools 1 to 16 of the present invention, the rust grinding efficiency was as high as 31 minutes/$m^2$ or less in all cases, and the rust grinding efficiency was particularly high (23 minutes/$m^2$ or less) when the sloped surface of the metal disk had stepped configuration (Examples other than the Example 2).

In contrast, in the case of Comparative Examples 1 to 3, the highest rust grinding efficiency was 43 minutes/$m^2$ of Comparative Example 1.

As described above, clear difference in the rust grinding efficiency was confirmed between the Examples and the Comparative Examples.

Such clear difference is conceivably due to the shape of the rotary grinding tool, and in particular, due to the values of the angle between the front surface of the metal disk and the rotary axis, $W_1$, $W_2$, and $W_1/W_2$ which are within the preferable range in the case of the Examples.

REFERENCE SIGNS LIST

1 the grinding tool of the present invention
2 metal disk
21 front surface of the metal disk
22 sloped surface of the metal disk
23 side surface of the metal disk
24 rear surface of the metal disk
25 groove
26 bolt
3 holder
6 bolt
7 securing means (securing hole)
8 hard grains
9 grinding surface
X normal line
Y rotary axis
$W_1$ width in radial direction in projected plane when seen from the side of the front surface
$W_2$ width in radial direction in projected plane when seen from the side of the front surface $W_3$ width of the side surface of the metal disk
L boundary line
V space on the front side of the securing means

The invention claimed is:

1. A rotary grinding tool with reduced noise level, comprising a metal disk having a grinding surface on at least a part of a surface of the metal disk, the grinding surface having hard grains having a Mohs hardness in excess of 9 brazed thereon at a surface density of at least 20 grains/$cm^2$, and a holder for supporting the metal disk, the holder having securing means for securing the holder on a rotary shaft of a rotary drive unit, the metal disk being joined to the holder, wherein the surface of the metal disk has a front surface, a sloped surface, a side surface, and a rear surface, the front surface, the sloped surface, and the side surface being continuously formed in this order from a center side to a peripheral side of the metal disk, the rear surface, being located at the back of the front surface and the sloped surface and adjacent to the side surface, the front surface being perpendicular to a rotary axis, and the side surface being parallel to the rotary axis.

2. A rotary grinding tool with reduced noise level according to claim 1, wherein the metal disk and the holder are joined to each other by bolts.

3. A rotary grinding tool with reduced noise level according to claim 1, wherein a space is formed on a front side of the securing means by joining the metal disk with the holder, the space having a volume of at least 7000 $mm^3$.

4. A rotary grinding tool with reduced noise level according to claim 1, wherein the metal disk has a thickness of 3.0 to 6.0 mm and a weight of 100 to 1000 g, the holder has a thickness of 3 to 10 mm, and a percentage of contact area of the metal disk and the holder in an area of the rear surface of the metal disk is 30 to 100%.

5. A rotary grinding tool with reduced noise level according to claim 1, wherein the metal disk comprises a stainless steel material, and the holder comprises an aluminum alloy material.

6. A rotary grinding tool with reduced noise level according to claim 1, wherein the sloped surface of the metal disk has a stepped configuration.

7. A rotary grinding tool with reduced noise level according to claim 1, wherein the front surface has a first width (W1) in radial direction in a projected plane seen from the front side, and the sloped surface of the metal disk has a second width (W2) in the radial direction in the projected plane seen from the front side, and W1/W2 is greater than 2.0, and W2 is at least 1 mm.

8. A rotary grinding tool with reduced noise level according to claim 1, wherein the sloped surface of the metal disk has an area of at least 400 $mm^2$.

9. A rotary grinding tool with reduced noise level according to claim 1, further comprising a vibration absorber comprising an organic, inorganic, or metal material provided at least at a part of a boundary or joint between the metal disk and the holder.

10. A method for producing a rotary grinding tool with reduced noise level according to claim 1, the method comprising:

coating a filler powder mixed with an organic binder on at least a part of the front surface, the sloped surface, the side surface, and the rear surface of the metal disk to a thickness corresponding to 20 to 60% of the average particle diameter of the hard grains having a Mohs hardness in excess of 9, applying the hard grains having a Mohs hardness in excess of 9 to a surface density of at least 20 grains/$cm^2$, maintaining the metal disk at a reduced pressure of up to 10-4 Torr at a temperature of 1000 to 1040° C. for 10 to 50 minutes to prepare the metal disk having a grinding surface, and joining the metal disk with the holder to obtain the grinding tool.

* * * * *